United States Patent [19]

Singer

[11] 4,393,927

[45] Jul. 19, 1983

[54] APPARATUS FOR POSITIONING A TREATING LIQUID AT THE BOTTOM OF A WELL

[76] Inventor: Mortimer Singer, 2320 Plaza del Grande, Las Vegas, Nev. 89102

[21] Appl. No.: 245,361

[22] Filed: Mar. 19, 1981

Related U.S. Application Data

[63] Continuation-in-part of Ser. No. 94,381, Nov. 15, 1979, Pat. No. 4,267,888.

[51] Int. Cl.[3] ..... E21B 37/00; E21B 37/06

[52] U.S. Cl. ..... 166/105; 166/305 R; 166/68; 166/312

[58] Field of Search ..... 166/51, 68, 68.5, 106, 166/112, 304, 305 R, 311, 312

[56] References Cited

U.S. PATENT DOCUMENTS

| | | | |
|---|---|---|---|
| 2,588,578 | 3/1952 | Santiago | 166/106 |
| 3,014,531 | 12/1961 | Weaver | 166/304 |
| 3,873,238 | 3/1975 | Elfarr | 166/68 |
| 4,079,998 | 3/1978 | Huff et al. | 166/106 |
| 4,279,306 | 7/1981 | Weitz | 166/312 |

*Primary Examiner*—Stephen J. Novosad
*Assistant Examiner*—William P. Neuder
*Attorney, Agent, or Firm*—Daniel Silverman

[57] ABSTRACT

This invention relates to a method and apparatus for positioning a selected liquid at the bottom of a well, such as an oil well, while having in the well at least a string of tubing, a sucker rod pump, a string of sucker rods, and a standing valve, without disturbing the rods, pump, tubing, or standing valve. A bypass conduit or shroud surrounds the wall of the tubing at a point above the pump where there is an opening in the wall of the tubing and is carried down, outside the tubing to a point below the conventional mud anchor, into the inlet of an overpressure relief valve. The outlet of the valve empties into the well annulus. If the normal pressure at the bottom of the tubing due to the head of liquid in the tubing is P, the overpressure valve is set to open at a pressure of P+P1, where P1 is a selected value, such as say 100 psi. At the surface, means are provided to close off the top of the tubing. Means are provided to inject the selected liquid into the top of the tubing at a selected pressure P2 above atmospheric, where P2 may be say 150 psi. This causes the pressure at the bottom of the tubing to rise to P+P2. Since P+P2 is now greater than P+P1, the overpressure valve will open and pass as much liquid as is pumped into the tubing at the surface. A crossflow unit is inserted into the tubing and the shroud at the standing valve to permit the radial flow of well fluids from outside the shroud to the inlet to the standing valve, and to permit the longitudinal flow of liquid down the annulus inside the shroud, to the relief valve.

11 Claims, 5 Drawing Figures

APPARATUS FOR POSITIONING A TREATING LIQUID AT THE BOTTOM OF A WELL

CROSS-REFERENCE TO RELATED APPLICATION

This application is a continuation-in-part of my copending application, Ser. No. 94,381, filed Nov. 15, 1979 entitled: Method and Apparatus for Positioning a Treating Liquid At the Bottom of a Well, application Ser. No. 94,381 is now U.S. Pat. No. 4,267,888.

BACKGROUND OF THE INVENTION

1. Field of the Invention

This invention lies in the field of wells, such as oil wells, and, more particularly, wells which have a string of tubing and are pumped by sucker rod pumps installed in the tubing.

Still more particularly, it concerns wells which produce water, which carries chemicals, which precipitate out in the pores and on the face of the producing formation. This precipitate material must be removed by frequent treatment with various chemicals, including acids, etc. as well known in the art.

The problem is to place the selected volume of treating liquid in the bottom of the well without disturbing the tubing, rods, and other equipment in the well.

2. Description of the Prior Art

The present method of positioning the quantity of treating liquid on the bottom of the well involves, at the least, removing the sucker rods, pump plunger, and standing valve, and pumping the treating liquid into the top of the tubing. At the most, it involves also removing the tubing, and positioning the treating liquid into the bottom of the casing by high pressure pumping equipment. While the latter is the best available method, it is very expensive and time consuming, and cannot be afforded on wells with low production, particularly when such wells require frequent treating. This often leads to the early abandonment of the well, and the loss of all potential future production.

The first method, being the least costly method, is the method most often used, but it still costs a very significant amount for certain types of wells, and also represents a loss of production during the time that the well is shut down, etc.

The present invention is directed to a method and apparatus for accomplishing this treatment process in a more efficient and for less costly manner with substantially no down time of the well.

SUMMARY OF THE INVENTION

It is a primary object of this invention to provide a method and apparatus for placing a selected volume of a selected liquid in the bottom of a well having tubing, sucker rod pump, sucker rods, and standing valve, without disturbing the rods, pump, tubing or standing valve.

It is a further object of this invention to provide in a well having tubing, rods, rod pump, and standing valve, a method and apparatus for positioning a slug of treating liquid of selected size at any point along the length of the tubing.

These and other objects are realized, and the limitations of the prior art are overcome in this invention by the installation of a bypass conduit along the outside of the tubing. The top of the bypass enters the wall of the tubing above the pump. The bottom end is preferably below the lowest portion of the equipment hanging on the string of tubing. The bottom end leads into an overpressure or relief valve which is attached to the lowermost portion of the tubing. Thus the bypass conduit carries liquid from the tubing above the pump down to the overpressure valve and bypasses the two check valves, the traveling valve, and the standing valve.

Let the pressure at the bottom of the tubing be P, which is the hydrostatic head of the column of liquid in the tubing. The overpressure valve is set to open at a valve of P+P1, where P1 is a selected value of overpressure, say 100 psi. So as long as the pressure in the tubing is P, the valve will not open.

To open the valve, the tubing is closed at the top and means are provided to inject the selected fluid into the tubing at a selected pressure of P2 above atmospheric pressure, where P2 is greater than P1. When the surface pressure is raised to P2, then the pressure at the bottom of the tubing increases to P+P2. Since this is greater than P+P1, the valve will open and pass liquid as long as the pressure P2 is applied, by continuing injection of liquid. The volume of liquid bypassed through the overpressure valve will be equal to the volume injected at the top of the tubing.

When the volume of liquid injected is equal to the internal volume of the string of tubing, all of the original well liquid which had been standing in the tubing will be filled with the selected treating liquid. To get this treating liquid from the tubing into the well, an additional volume of pusher liquid is injected. Then all of the treating liquid will be in the well bore. The pusher liquid can be any liquid, but is preferably oil or produced water readily available from the field tank since, when the sucker rod pump is again started, this liquid will be pumped back into the field tank.

By selecting volumes of treating liquid and pusher liquid, a slug of treating liquid can be positioned at any desired point in the tubing.

This method and apparatus can be applied to wells of any depth that are being pumped by sucker rod pumps. The cost of equipping shallow or deep wells with this invention is about the same, while the potential saving in service costs goes up very rapidly with increased depth. So the method is economically more attractive in deep wells.

BRIEF DESCRIPTION OF THE DRAWINGS

These and other objects and advantages of the invention, and a better understanding of the principles and details of the invention will be evident from the following description, taken in conjunction with the appended drawings, in which:

FIG. 1 is based upon FIG. 1 of my copending application, Ser. No. 94,381.

DESCRIPTION OF THE PREFERRED EMBODIMENT

Figure 1:
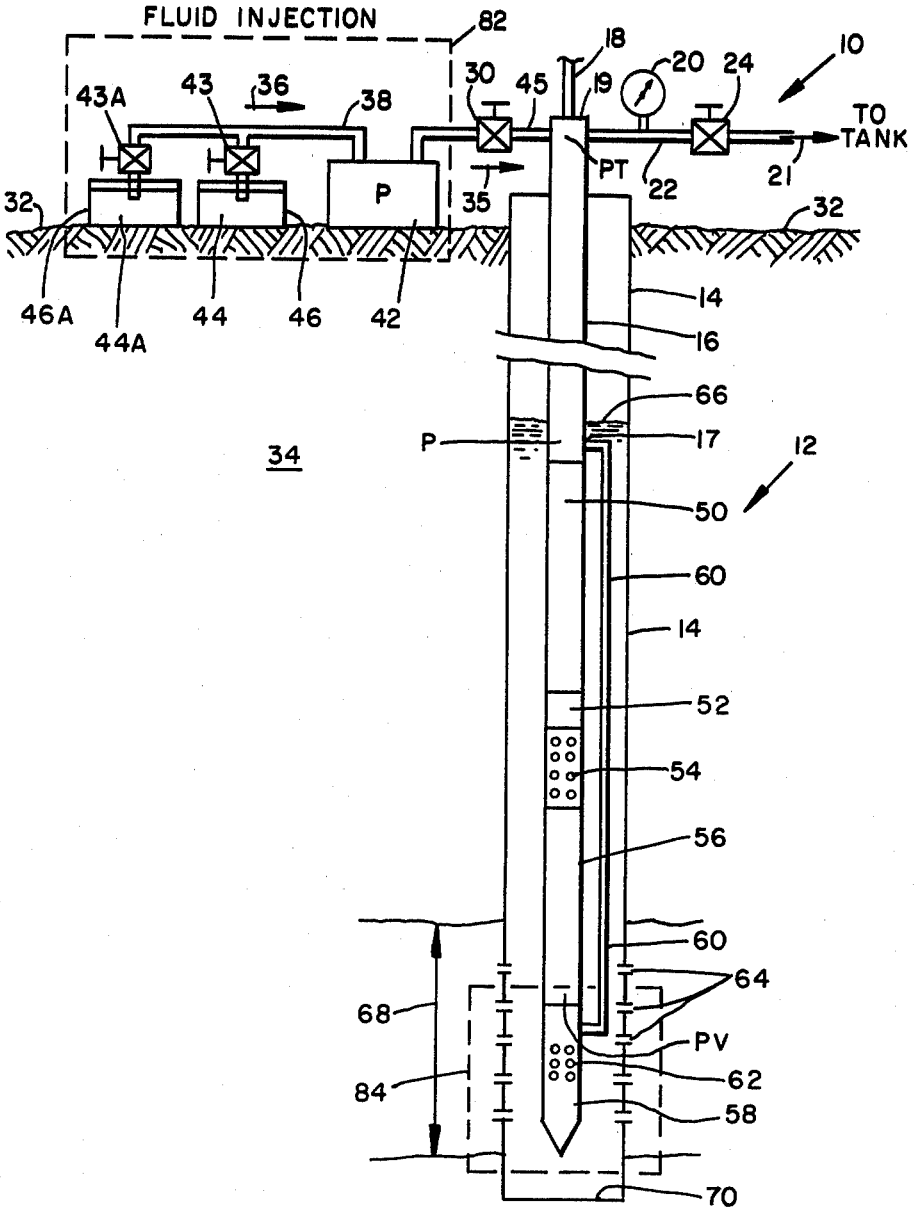
FIG. 1 is a schematic illustration of the conventional surface and downhole apparatus for pumping oil wells, indicating those parts of the system which are novel and form the basis for this invention.

As shown in FIG. 1, this invention comprises a system, including a surface apparatus coacting in a known manner with a downhole apparatus. The surface apparatus is indicated generally by the numeral 10, while the downhole apparatus is indicated generally by the numeral 12.

Much of the apparatus shown in FIG. 1 is old and conventional. The new parts are contained within the dashed boxes 82 at the surface and 84 at the bottom of the hole, and a third new element is the bypass pipe or conduit 60.

Box 82 is identified as a means to inject a selected liquid at a selected pressure into the top of the tubing 16 which can be closed by valve 24. Box 84 is an overpressure (relief) valve, and pipe 60 is a bypass connecting from an opening in the tubing above the rod pump, down to the overpressure valve 84. The rest of the system can be conventional.

The rest of the system includes a well, such as an oil well, including a casing 14, a string of tubing 16 extending from the surface down to a point near the bottom of the well, a string of sucker rods 18, a sucker rod pump 50, a coupling 52 housing the standing valve, a perforated nipple 54, and a mud anchor 56. As previously mentioned, all of these parts are conventional and are used on most pumping wells. Of course, another arrangement of parts can be used, which will operate just as well with this invention. The only requirement is that fluid inside the tubing can pass through an opening 17 in the tubing 16, into the bypass conduit 60 down to an overpressure valve 84.

When the equipment is in normal use, operating means (not shown, but well known in the industry) is provided to alternately raise and lower the sucker rods 18, through a selected distance, on a selected time schedule. The bottom end of the sucker rods is connected to the plunger in the pump 50, and the plunger is movably sealed inside of the barrel of the pump 50. The length of the barrel is, of course, longer than the travel distance of the rods and plunger.

There is a check valve in the plunger, called the traveling valve, which, on the downstroke of the plunger permits well fluid to pass through the valve from the space below, to the space above, the plunger. On the upstroke of the plunger the traveling valve closes and the plunger, lifted by the rods, lifts the entire column of well fluid in the tubing, from the plunger up to the surface.

As the plunger moves up, the space below the plunger has a greatly reduced pressure, and the pressure head of the fluid standing in the annulus 66 forces well fluids from the annulus in through the openings in the perforated nipple 54, up through the standing valve, in the coupling 52 below the pump 50. Thus, the pair of check valves, the traveling valve and the standing valve, in combination with the stroking of the plunger, lifts fluid from the annulus, up the string of tubing 16 to the surface, where it passes through the gathering line pipe 22 and valves 24 to the field tank (not shown but well known in the industry) in accordance with arrow 31.

In the course of well operations many troubles can occur. For example, the water in the oil formation may contain certain chemicals in solution in the pores of the rock, but under the reduced pressure in the well annulus, these chemicals precipitate from solution and deposit inside the pores of the rock and on the rock wall, or face. After a time these deposits become heavy enough to coat the walls and greatly reduce the flow of liquid into the well. It then becomes necessary to position a batch of treating liquid on the bottom of the well. There are many such treating liquids known to the industry. The particular liquid forms no part of this invention. The invention is concerned with apparatus for facilitating this placement of such a treating liquid.

From the above description of the apparatus it will be clear that such liquid can be poured down the well annulus from the surface. This is a very unsatisfactory method for many reasons. It is clear also that it is impossible to pour liquid down the tubing, because the passage is closed by two check valves. The most satisfactory way is to pull the sucker rods, pump, standing valve and tubing, and to place the liquid on bottom by high pressure pumping means, as is well known. This is a very expensive and time consuming method.

A less satisfactory, though practically useful method is to pull rods, plunger and standing valve. The fluid in the tubing will then flow out the bottom end of the tubing, outwardly through the perforated nipple, into the annulus. Now the selected liquid can be pumped or poured down the tubing into the annulus. This method is much less expensive and time-consuming than the first method, but it is too expensive to justify for frequent operations. A simpler and cheaper method is required.

A small opening 17 is cut through the wall of tubing 16, just above the pump 50. Bypass conduit 60 is sealed into this opening 17 and is carried down to a point below the mud anchor 56. This bypass cannot be left open, since it would prevent the pump from pumping. In fact, all the fluid in the tubing would flow down the tubing through the opening 17 and the bypass into the annulus, and, of course, the bypass is needed as a way to get past the two check valves. The bypass is closed on its bottom end by an overpressure valve 58, or conventional relief valve.

There is a normal pressure P inside the tubing at the position of the opening 17, which represents the pressure head of the column of fluid. So the overpressure valve 58 must be set to open at some selected pressure, PV, greater than P, by an additional pressure P1, where P1 is say, for example, 100 psi. Thus $PV=P+P1$, where $P1 \cong 100$ psi.

Now, the overpressure valve 58 will keep the bottom end of the bypass 60 closed at all times during normal operation of the pump. If it is desired to open the bypass the pressure at opening 17 must be raised from P to a pressure higher than PV. This is done by closing off the tubing at the surface by closing valve 24 (which is normally open during pumping) and injecting liquid through pipe 45, into the tubing at a selected pressure P2. If P2 is set to be say, 200 psi above atmospheric, then the hydrostatic pressure at the bottom of the tubing will be $P+P2$, or $P+200$. Since $PV=P+100$, this excess pressure will open the overpressure valve, and it will pass a volume of liquid equal to that injected at the surface, by the means to inject, 82.

This means 82 can comprise a conventional pump 42 and tank 46 of treating liquid 44. This liquid will flow in pipe 38 in the direction of arrow 36 to the pump inlet, and from the pump outlet through pipe 45 to the tubing 16 in accordance with arrow 35. The valve 30 is normally closed when the well is pumping and provides a quick connection with the interior of the tubing. Pressure gauge 20 indicates the injection pressure.

It will be clear that while this injection of liquid is taking place the normal operation of the rods and pump are stopped.

It will be clear also, that whenever the sucker rod pump is stopped, the tubing remains filled with well fluid. Thus when fluid 44 is injected into the top of the tubing, none of it reaches the annulus through the overpressure valve 58, until all of the well fluid standing in the tubing first empties into the annulus. Also when the selected volume of fluid 44 is injected into the tubing, the tubing will be at least partially full of the fluid 44, until an additional volume of a driving fluid, such as well fluid or water is injected to fill the tubing with driving fluid and empty the treating fluid into the well.

It will be convenient at the surface to have two tanks 46 and 46H, one for the treating liquid 44, and the other for the pusher liquid 44A. Each tank has its own shut-off valve 43, 43A respectively to select the proper liquid.

While the well in FIG. 1 is shown as cased to the bottom and cemented 70, and the casing perforated 64 through the producing zone 68, the casing could just as well be anchored above the producing zone, leaving the face of the producing zone open, as is well known.

Also, while FIG. 1 shows a single bypass conduit or pipe 60, it will be understood that this is a purely schematic representation, and any number of separate pipes may be used, or any other selected design can be used, keeping in mind the need to maintain a minimum overall diameter, so that the device can be installed in a well with minimum diameter of casing.

FIG. 1 is a purely schematic drawing for illustrating the principle of my invention.

Figure 2:
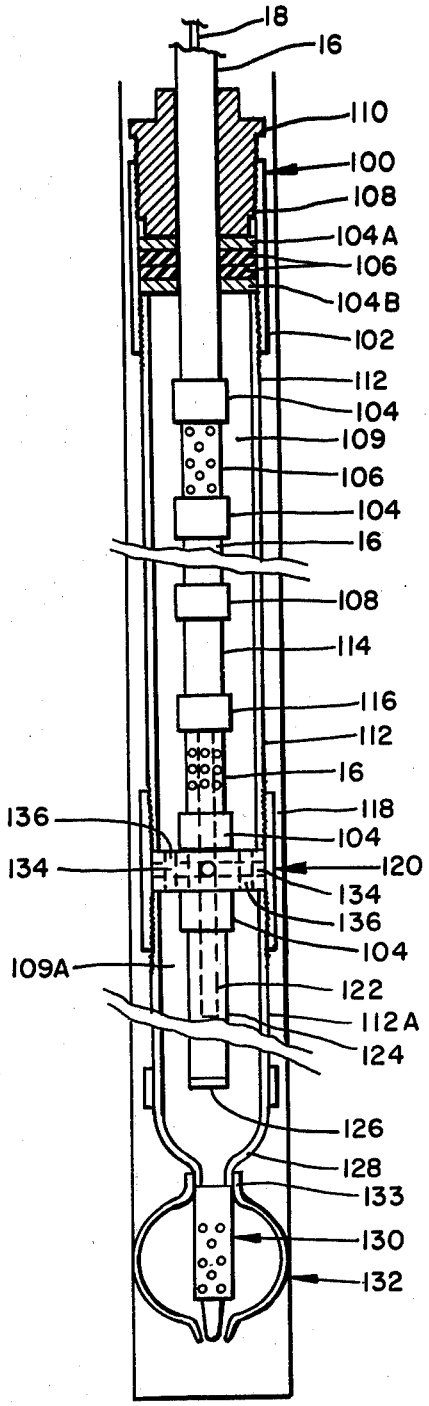
FIG. 2 is a schematic drawing of the preferred embodiment of this invention.

Referring now to FIG. 2, there is shown a preferred embodiment of my invention. Illustrated is the bottom end of a string of tubing 16 which extends to the surface 32, and is supported at the wellhead. Inside the tubing is a string of sucker rods 18, which also extend to the surface 32. There is a tubing coupling or collar 104, into which is screwed a short length of perforated tubing 106, which corresponds to the first opening 17 of FIG. 1. This permits fluid inside the tubing to flow into the bypass pipe.

The element 114 is the pump barrel, corresponding to 50 of FIG. 1. The pump plunger with its traveling valve reciprocates sealably inside of the barrel to effect the pumping. Neither the pump plunger nor the barrel are shown in FIGS. 1 or 2, but are illustrated and described in my co-pending application, Ser. No. 94,381, to which reference has been made. This art is well known and described in textbooks and needs no further explanation.

The coupling or collar 116 forms the base of the pump barrel (corresponds to 52 of FIG. 1) and supports the standing valve. This is well illustrated and described in Ser. No. 94,381 and is well known in the art, and needs no further explanation. The dashed outline 122 represents the gas anchor, corresponding to 118 of FIG. 3 of Ser. No. 94,381. Similarly, the mud anchor 124 surrounds the gas anchor 122 and corresponds to 128 of FIG. 3 of Ser. No. 84,381.

In FIG. 1, numeral 54 illustrates a perforated section of tubing that permits well fluids to flow into the mud anchor, up the gas anchor through the standing valve and into the pump barrel.

In FIG. 2, instead of the perforated nipple 54 of FIG. 1, there is shown a cross-flow unit, or cross-over unit 120, which will be described in detail in connection with FIGS. 4 and 5. As illustrated schematically, it is an assembly which is supported by the tubing string 16, and which supports the mud anchor 124.

The cross-over unit has a large central opening equal in size to the interior of the tubing. It has an outer ring which supports the outer pipe 112 and 112A which is concentric with the tubing 16. The outer ring of the cross-over unit has one or more radial openings 134, through which well fluid can flow from outside of the outer pipe 112 into the mud anchor and up through the standing valve.

There are also one or more longitudinal holes 136, through which fluid inside the annular space 109 between the tubing 16 and the outer pipe 112 can flow down into the annular space 109A, and out the bottom end of the outer pipe 112. The outer pipe 112 is a bypass pipe corresponding to bypass pipe 60 of FIG. 1. It is also called a shroud, since it surrounds the tubing string 16.

The shroud 112 is supported by the crossflow or cross-over unit 120. It is sealed to the tubing 16 at its top end by means of a packoff unit 100. This comprises an outer cylindrical wall or housing, adapted to be screwed to the top of the shroud. It has ring means 104A, 104B for supporting between them a compliant ring 106. A hollow screw 110 is threaded into the outer wall and compresses the compliant ring 106 to seal the upper end of the shroud to the tubing. This packoff unit will be fully described in connection with FIG. 3.

At the bottom end of the shroud 112 and 112A, there is a reducing coupling 128, to which is attached an overpressure valve or relief valve 130, which is fully described in connection with FIG. 3 of Ser. No. 94,381. the overpressure or relief valve is a commercial item made by many manufacturers, and needs no further description.

On the bottom end of the assembly of FIG. 2 is a set of centralizing openings 132 which are azimuthly spaced and welded at their upper ends to the pipe 128 at 133. They form no part of the bypass invention but serve to protect the relief valve 130 from damage. Also, as they spring out into contact with the casing, or open wall of the formation, and as the bottom end of the tubing rises and falls in synchronism with the pump strokes, the springs will tend to keep the wall free of deposits of chemicals precipitating out of solution.

In operation, when the tubing string is filled with fluid, there will be a hydrostatic pressure P at the opening 106, which is a function of the density of the fluid and the vertical length of the column. When the tubing is full, it will flow through the perforated nipple 106 into the annular space 109 and fill all this space above the relief valve 130. The pressure P will be at point 106. There will also be a small pressure due to the small additional head from 130 to 106, which we can disregard.

Of course, the relief valve must be set to open at a higher pressure than P, otherwise all of the fluid in the tubing will flow down through the bypass and the valve 130 into the well. Therefore the relief valve is set to open at some selected value of pressure over P, say P1, which can be say, for example, but not by limitation, 100 psi. Therefore, the valve will open on a pressure P+P1, or P+100 psi.

To open the valve 130 the pump is stopped and the valve 24 of FIG. 1 is closed, which closes off the top end of the tubing. Then valve 30 is opened and a selected volume of fluid at a pressure above atmospheric, of P2, which must be higher than P1, is pumped into the tubing. Say P2 is 200 psi, for example, the pressure PV at the valve 130 will then be P+200 psi and it will open and permit flow from the bypass and from the tubing.

Consider that the tubing is filled with liquid and a liquid of substantially the same density is injected in the tubing at the surface. Then, for every gallon pumped in at the top, an equal volume will flow out through the valve at the bottom. Assume that the volume pumped in is less than the volume of the tubing. In this case all of the first liquid pumped in, or injected into, the tubing will remain in the tubing. To get this volume of first liquid into the bottom of the well, a second liquid, called a pusher liquid, is injected on top of the first liquid. Then when the volume of pusher liquid injected is equal to the volume of the tubing, all of the first liquid will be expelled into the bottom of the well, and the tubing will be filled with pusher liquid, and so on.

Figure 3:
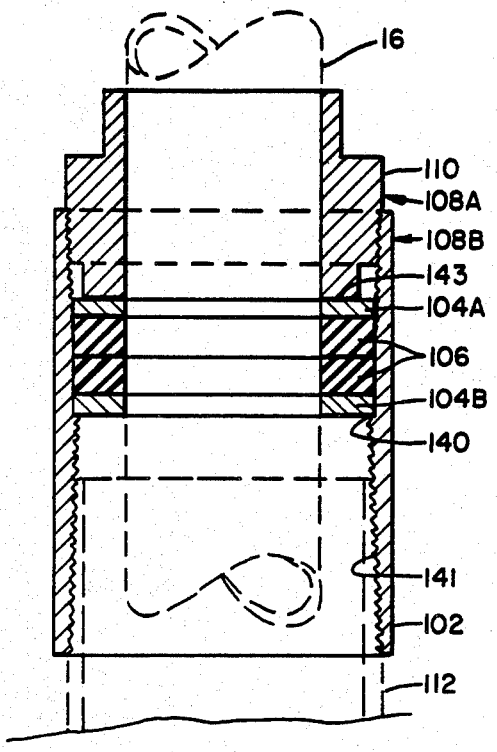
FIG. 3 provides more detail of the packoff unit of FIG. 2.

The principle of the overpressure valve is fully described in FIG. 3 of Ser. No. 94,381, which is the same as the conventional relief valve. However, in the conventional relief valve the restraining spring is generally surrounded by a housing to protect it, the housing being filled with air at atmospheric pressure. In general this is a small opening through which the air pressure inside the housing can be balanced to atmospheric pressure.

On the other hand, in this invention the relief valve is immersed in water or oil in the bottom of the well, and if water is trapped inside of the housing around the spring, then the ball will be prevented from moving down with the spring, and a much higher value of pressure on the valve will be required to open it.

Referring now to FIG. 3, there is shown one embodiment of a packoff unit 100 for sealing the upper end of the shroud 112 to the tubing string as shown in FIG. 1.

FIG. 3 shows the packoff unit 100 comprising an outer cylindrical pipe 102 with the bottom end threaded so as to be screwed to the top of the shroud 112. For this purpose the cylindrical pipe 102 can be a collar, designed to join the pieces of the shroud.

The upper portion of the pipe 102 is bored out to a larger diameter to provide an annular shoulder or shelf 140. The upper inside wall of the pipe is threaded with a cylindrical thread 108B (as contrasted with the tapering pipe thread 141 of the bottom portion).

A pair of steel rings 104A and 104B, are positioned above and below a compliant ring 106 of sealing material, such as neoprene. Actually the ring 106 is preferably made of two thinner pieces as shown in FIG. 3. The inner diameter of the steel and neoprene rings is slightly larger than the outer diameter of the tubing 16 so that they can be slipped over the tubing and into the top of the outer pipe 102.

A packing unit 110 is provided with an outer thread 108A to match the internal thread 108B on the inside of the pipe 102. The inner diameter of the packing unit 110 is the same as that of the rings 104, namely, slightly larger than tubing 16.

In assembling this unit the lower ring 104B rests on the shoulder 140, and the nut 110 presses down, with its bottom face 143 against the top ring 104A. This pressure is increased as the nut 110 is screwed into the top of the outer wall 102, and the compliant rings 106 are squeezed inwardly by the steel rings until they seal against the outer wall of the tubing 16.

Figure 4:
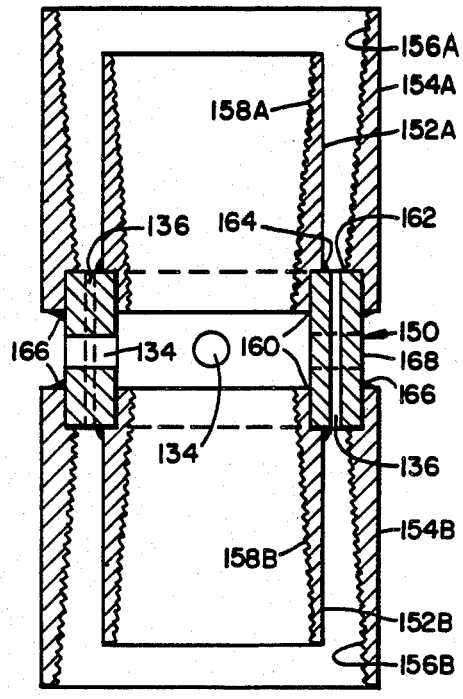
FIGS. 4 and 5 show details of two embodiments of the crossover unit of FIG. 2.

Referring now to FIG. 4, there is shown one embodiment of a crossflow unit, or crossover unit indicated generally by the numeral 150. It comprises a heavy-walled cylindrical ring of selected inner and outer diameter and height. There are at least 1 (or a plurality of) radial openings 134 through the wall of the ring. Four have been utilized in practice, but this is for convenience and not by way of limitation. Since the radial openings 134 are for passing well fluid from outside the shroud 112 to the inside of the tubing 16, and to the inlet of the pump, the cross-sectional area should be such as to provide this flow without too much pressure drop.

There are also at least 1 (a plurality) of longitudinal drilled openings 136 drilled through the wall in positions between the radial openings, so that there is no communication between the radial and longitudinal openings.

In the construction of FIG. 4, a tubing collar and a shroud collar are cut at their longitudinal midpoints into the pieces 152A, 152B from the tubing collar and 154A and 154B from the shroud collar.

The cut ends are machined as shown so that all the parts will be accurately centered and aligned concentrically. They are then welded 164, 166 to the ring, as shown. In this form, the ring is supported at the bottom of the tubing string by the part 152A, and in turn supports the mud anchor 124 (FIG. 2) by part 152B.

The crossover unit also supports the top portion of the shroud screwed into part 154A and the lower part of the shroud screwed into part 154B.

Figure 5:
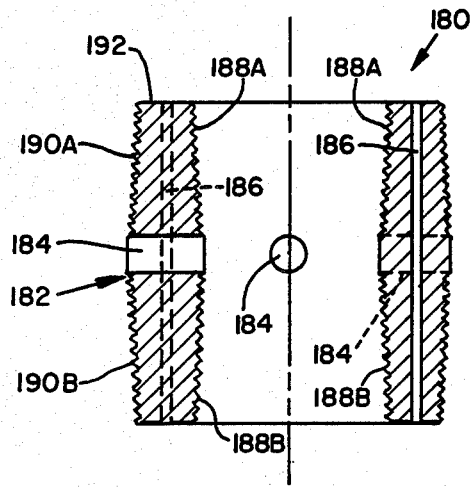

FIG. 5 illustrates another embodiment 180 in which the crossover unit comprises a thick-walled ring 192 with tapered female threads 188A, 188B on each end of the inner surface, to fit the threaded ends of the tubing. On each end of the outer surface are male tapered threads 190A, 190B adapted to fit the collars of the shroud. This embodiment is installed in much the same way as was described for FIG. 4.

As an example of the pipe sizes that might be used in practice, 2" tubing could conveniently be used for the tubing string, and a 2" tubing collar would be used in FIG. 4 for 152A and 152B. The internal threads 188A, 188B would be the same as the threads 158A, 158B of the 2" tubing collar. The shroud 112 can then conveniently be made from 3" tubing and a 3" tubing collar would be used for 154A, 154B of FIG. 4. The outer threads 190A, 190B would then mesh with a 3" tubing collar. These sizes, etc. are by way of example only, any compatible sizes can be used, as desired.

While I have used numbers of 100 and 200 psi respectively for P1 and P2, these are by way of example, and not by way of limitation.

Also, while the preferred embodiment is as illustrated in FIG. 2, it is possible to use a combination of the shroud construction as in FIG. 2 for the top portion of the bypass, and the small tubular construction of FIG. 1 for the bottom portion of the bypass, and so on.

I have described the operation of the sucker rod pump, pointing out that when the rods are moving up, the traveling valve is closed and the standing valve is open. At this time the weight of the column of liquid in the tubing is carried by the sucker rods. When the rods are moving down, the traveling valve is open and the weight of the column of liquid in the tubing is supported by the tubing. This alternating force on the tubing string causes it to stretch and elongate when the rods are moving down and to relax and shorten when the rods are moving up. This lengthening can be as much as 12 to 24 inches or more and makes it possible for the centering springs to act as scrapers to keep the wall of the borehole clean.

It will be clear that if it should be desired to place a selected volume of any selected treating liquid at a selected position inside the tubing, say at the bottom-most portion of the tubing, or at some intermediate level, or even the entire length of tubing, this can be done by injecting a selected slug of treating liquid, and then injecting a pusher liquid such as oil, water, and so on. Alternatively, the entire slug of treating liquid can be positioned in the bottom of the well, by making the volume of pusher liquid just enough to fill the tubing and so on.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim, or claims, including the full range of equivalency to which each element thereof is entitled.

What is claimed is:

1. In a liquid producing well having installed at least a string of tubing extending from the surface to the bottom, a standing valve, a sucker rod pump including a traveling valve, and a string of sucker rods, apparatus for positioning a selected volume of a selected fluid in the bottom of said well without disturbing said pump, rods, tubing, or standing valve, comprising;

(a) a first opening in said tubing above said sucker rod pump;

(b) a shroud, or cylindrical pipe, outside of, said tubing string, forming an annulus between said tubing and said shroud, said shroud extending to a point below the inlet to said sucker rod pump, from a point above said first opening; means to seal said shroud to the outside of said tubing string above said first opening;

(c) crossover means inserted into said tubing string in the vicinity of the inlet to said sucker rod pump; said crossover means sealed to said shroud; permitting radial flow of well fluid from outside said shroud to the inlet to said sucker rod pump, and also permitting longitudinal flow of fluid down said annulus from said first opening to the bottom of said shroud;

(d) an overpressure relief valve set to open at a selected fluid pressure on its inlet, said relief valve positioned at and closing off the bottom end of said shroud;

(e) at the mouth of said well, means to close off the top of said tubing string; and (f) means to inject at least a selected first volume of a selected first fluid, into said closed top end of said tubing at a selected pressure above atmospheric pressure.

2. The apparatus as in claim 1 in which said means to seal said shroud to the outside of said tubing string comprises expandable packer means.

3. The apparatus as in claim 2 in which said expandable packer means comprises;

(a) a thin-walled cylinder, or shell, and means to attach said shell to the top of said shroud;

(b) elastomeric ring means adapted to be slipped over said tubing, and shelf means in said shell for supporting, from the bottom, said elastomeric ring means;

(c) tubular cylindrical packing nut means adapted to be slipped over said tubing, and having threads on the outer surface matching threads on the inner wall of said shell;

whereby when said packing nut is screwed down in said shell it compresses said elastomeric ring means causing it to expand radially inwardly, and seal against the outer wall of said tubing.

4. The apparatus as in claim 3 including metal ring means above and below said elastomeric ring means, to transfer to said elastomeric ring means the compressive force provided by said shelf means and said packing nut means.

5. The apparatus as in claim 1 in which said crossover means comprises (a) a metallic cylindrical ring of selected concentric inner and outer diameter and height;

(b) at least one radial opening through the cylindrical wall of said ring near the longitudinal center thereof;

(c) at least one longitudinal opening through the wall of said ring;

(d) first means to attach and seal said tubing to the inside of said ring extending upwardly and downwardly; and (e) second means to attach and seal said shroud to the outside of said ring extending upwardly and downwardly.

6. The apparatus as in claim 5 in which said first means to attach and seal said tubing comprises internal pipe threads on the internal surface of said ring adapted to mesh with the threaded ends of said tubing.

7. The apparatus as in claim 5 in which said second means to attach and seal said shroud comprises; male pipe threads on the external surface of said ring adapted to mesh with the internal threads of a collar of said shroud.

8. The apparatus as in claim 5 in which said first means to attach and seal said tubing comprises two tubing collar means welded to the inner surface of said ring, extending out of each end of said ring.

9. The apparatus as in claim 5 in which said second means to attach and seal said shroud comprises two shroud collar means welded to the outer surface of said ring, extending out of each end of said ring.

10. The apparatus as in claim 1 including spring centralizer means mounted on the bottom end of said shroud means;

whereby when said sucker rod pump is operating, and the bottom end of said tubing and shroud will rise and fall in synchronism with said pump strokes, and said centralizer will scrape the wall of said borehole.

11. The apparatus as in claim 1 including means to inject a second selected volume of a second selected fluid into said closed end of said tubing at a selected pressure above atmospheric pressure.

* * * * *